US007798085B2

(12) United States Patent
Burnette

(10) Patent No.: US 7,798,085 B2
(45) Date of Patent: Sep. 21, 2010

(54) APPARATUS, SYSTEMS AND METHODS FOR DISCONNECTING AN ELONGATED MEMBER EXTENDING FROM A WATERBORNE VESSEL

(75) Inventor: Blake Burnette, Spring, TX (US)

(73) Assignee: BJ Services Company, Houston, TX (US)

( * ) Notice: Subject to any disclaimer, the term of this patent is extended or adjusted under 35 U.S.C. 154(b) by 197 days.

(21) Appl. No.: 12/171,603

(22) Filed: Jul. 11, 2008

(65) Prior Publication Data

US 2009/0020060 A1 Jan. 22, 2009

Related U.S. Application Data

(60) Provisional application No. 60/961,344, filed on Jul. 20, 2007.

(51) Int. Cl.
*B63B 21/00* (2006.01)

(52) U.S. Cl. ..... 114/230.21; 114/230.23

(58) Field of Classification Search ..... 114/230.21, 114/230.23
See application file for complete search history.

(56) References Cited

U.S. PATENT DOCUMENTS 4,200,052 A * 4/1980 Cunningham et al. .. 114/230.21
4,441,582 A * 4/1984 Ward, Jr. ..... 182/48
5,123,374 A * 6/1992 McMillan ..... 114/230.3
5,365,872 A * 11/1994 Obrinski ..... 114/230.24

* cited by examiner

*Primary Examiner*—Stephen Avila
(74) *Attorney, Agent, or Firm*—E. Randall Smith; Jones & Smith, LLP

(57) ABSTRACT

In some embodiments, apparatus for disconnecting at least one elongated member extending between a waterborne vessel and at least one other object includes a cable extendable between the waterborne vessel and the other object. When the distance between the waterborne vessel and the other object exceeds a certain distance, the cable causes the at least one elongated member to be released from the vessel or other object.

22 Claims, 3 Drawing Sheets

APPARATUS, SYSTEMS AND METHODS FOR DISCONNECTING AN ELONGATED MEMBER EXTENDING FROM A WATERBORNE VESSEL

This application claims priority to the U.S. provisional patent application Ser. No. 60/961,344 filed Jul. 20, 2007, entitled "Emergency Disconnect System", the disclosure of which is hereby incorporated by reference herein in its entirety.

FIELD OF THE INVENTION

The present disclosure relates generally to systems, apparatus and methods useful to disconnect an elongated member extending between a waterborne vessel and another object.

BACKGROUND OF THE INVENTION

In various operations, one or more elongated members, such as hoses, pipes, power cables, etc., are temporarily deployed between a waterborne vessel, such as a boat, and another vessel, object or structure. During such operations, circumstances may arise that make it necessary or desirable to release the elongated member(s), such as in an emergency or when the distance between the vessel and the other item exceeds a desired distance or cannot be maintained.

For example, subsurface hydrocarbon recovery operations from offshore structures, such as platforms or rigs, sometimes requires the use of fluids delivered by specially designed vessels. The fluids are often provided through high pressure hoses, or flexible or rigid pipes extending from the vessels. Successful transmission of fluid from the vessel to the structure typically requires maintaining proper alignment and distancing of the vessel relative to the structure. In fact, these vessels are often equipped with thrusters or other systems to dynamically maintain their position. However, it is not always possible or desirable to maintain the proper positioning of the vessel/structure or engagement of the elongated member. For example, events may occur causing a sudden change in the vessel's position or warranting disengagement of the hose/pipe. In these and other instances, it may be difficult or impossible to effectively or quickly stop the supply of fluid from the vessel to the platform or rig and/or disconnect the hose or pipe from between them.

Accordingly, there exists a need for apparatus, systems and methods useful for disengaging an elongated member extending from a vessel to another vessel, structure or other object having one or more of the following attributes, capabilities or features: is capable of quickly disconnecting the vessel from the other vessel, structure or other object; effectively disconnects a vessel from a structure in an emergency situation; provides an automatic disconnect of an elongated member extending between a vessel and another item when the distance between them exceeds a desired distance; disconnects an elongated member extending between a vessel and another item in a timely manner; disconnects an elongated member extending between a vessel and another item without increasing the risk of injury, property damage and/or substantial loss of material; provides a quick release for a hose extending between a vessel and another item; includes a rip cord for automatically disconnecting at least one elongated member extending between a vessel and another object; automatically disconnects a high pressure or high volume fluid hose extending between a vessel and a structure; automatically stops the flow of fluid into a high pressure or high volume fluid hose extending between a vessel and a structure and automatically disconnects the hose from either the vessel or the structure; actuates a relief valve to release pressure in a high pressure or volume hose extending between a vessel and a structure and automatically disconnects the hose from either the vessel or the structure; or any combination thereof.

It should be understood that the above-described examples, features and/or disadvantages are provided for illustrative purposes only and are not intended to limit the scope or subject matter of the claims of this patent or any other patent application or patent claiming priority hereto. Thus, none of the appended claims or claims of any related application or patent should be limited by the above discussion or construed to address, include or exclude the cited examples, features and/or disadvantages, except and only to the extent as may be expressly stated in a particular claim.

BRIEF SUMMARY OF THE INVENTION

In some embodiments, the present disclosure involves apparatus having at least one elongated member extendable between a waterborne vessel and a structure located proximate to the waterborne vessel. The elongated member is releasably engageable with the waterborne vessel. A decoupler is disposed upon the waterborne vessel and associated with the elongated member(s). The decoupler is configured to release the elongated member(s) from the waterborne vessel when the distance between the waterborne vessel and the structure exceeds a desired distance. The apparatus also includes a cable extendable between the vessel and the structure. The cable includes at least a first portion useful to anchor the cable to the structure and at least a second portion useful to releasably attach the cable to the vessel. The second portion of the cable is associated with and capable of actuating the decoupler. When the distance between the vessel and the structure exceeds a desired distance, the second portion of the cable is capable of causing the decoupler to release the elongated member from the vessel.

There are embodiments of the present disclosure involving apparatus having at least one elongated member extendable between a waterborne vessel and another object. The elongated member originates from the other object and is releasably engageable with the other object. A decoupler is disposed upon the other object and capable of releasing the elongated member(s) from the other object when the distance between the waterborne vessel and the other object exceeds a desired distance. A cable extends between the other object and the vessel. The cable includes at least a first portion useful to anchor the cable to the vessel and at least a second portion useful to releasably attach the cable to the other object. The second portion is associated with and capable of actuating the decoupler. When the distance between the vessel and the structure exceeds a desired distance, the second portion of the cable is capable of causing the decoupler to release the elongated member from the other object.

In various embodiments, the present disclosure involves apparatus having at least one elongated member configured to extend between a waterborne vessel and another object. The elongated member originates from the waterborne vessel and is releasably engageable with the waterborne vessel. A decoupler is disposed upon the waterborne vessel and capable of releasing the elongated member(s) therefrom. A rip cord is extendable between the vessel and the other object. The rip cord includes at least a first portion useful to anchor the cable to the other object and at least a second portion useful to releasably attach the rip cord to the vessel. The second portion of the cable is associated with the decoupler and capable of causing the decoupler to release the elongated member from the vessel. When the distance between the vessel and the other object exceeds the length of the cable between the first and second portions thereof, the second portion of the rip cord causes the decoupler to release the elongated member from the vessel and also causes the rip cord to release from the vessel.

In many embodiments, the present disclosure involves systems for disconnecting at least one fluid conduit extending from a waterborne vessel to a structure when the distance therebetween exceeds a desired distance. The vessel includes at least one pump capable of pumping fluid into the fluid conduit and a fluid conduit disconnect capable of releasing the fluid conduit from the vessel. A first switch is capable of causing the pump to stop pumping fluid into the fluid conduit and a second switch is capable of causing the fluid conduit disconnect to release the fluid conduit from the vessel. A rip cord is releasably engageable between the vessel and the structure. The rip cord is associated with and capable of actuating the first and second switches to cause the pump to stop pumping fluid into the fluid conduit and the fluid conduit to be separated from the vessel, respectively, when the distance between the vessel and the structure exceeds a desired distance.

In various embodiments, the present disclosure involves methods of automatically disconnecting a waterborne vessel from a structure. The vessel and structure are releasably connectable by at least one elongated member extending from the vessel. These embodiments include providing a decoupler on the vessel, the decoupler being capable of releasing the elongated member from the vessel. A first portion of a cable is anchored to the structure and a second portion of the cable is associated with the decoupler and capable of causing the decoupler to release the elongated member from the vessel. The second portion of the cable is releasably connected to the vessel. When the distance between the vessel and the structure exceeds a particular distance, the second portion of the cable causes the decoupler to release the elongated member from the vessel and also causes the cable to disconnect from the vessel.

Accordingly, the present disclosure includes features and advantages which are believed to enable it to advance elongated member release technology. Characteristics and advantages of the present disclosure described above and additional features and benefits will be readily apparent to those skilled in the art upon consideration of the following detailed description of various embodiments and referring to the accompanying drawings.

BRIEF DESCRIPTION OF THE DRAWINGS

The following figures are part of the present specification, included to demonstrate certain aspects of various embodiments of this disclosure and referenced in the detailed description herein.

DETAILED DESCRIPTION OF PREFERRED EMBODIMENTS

Figure 1:
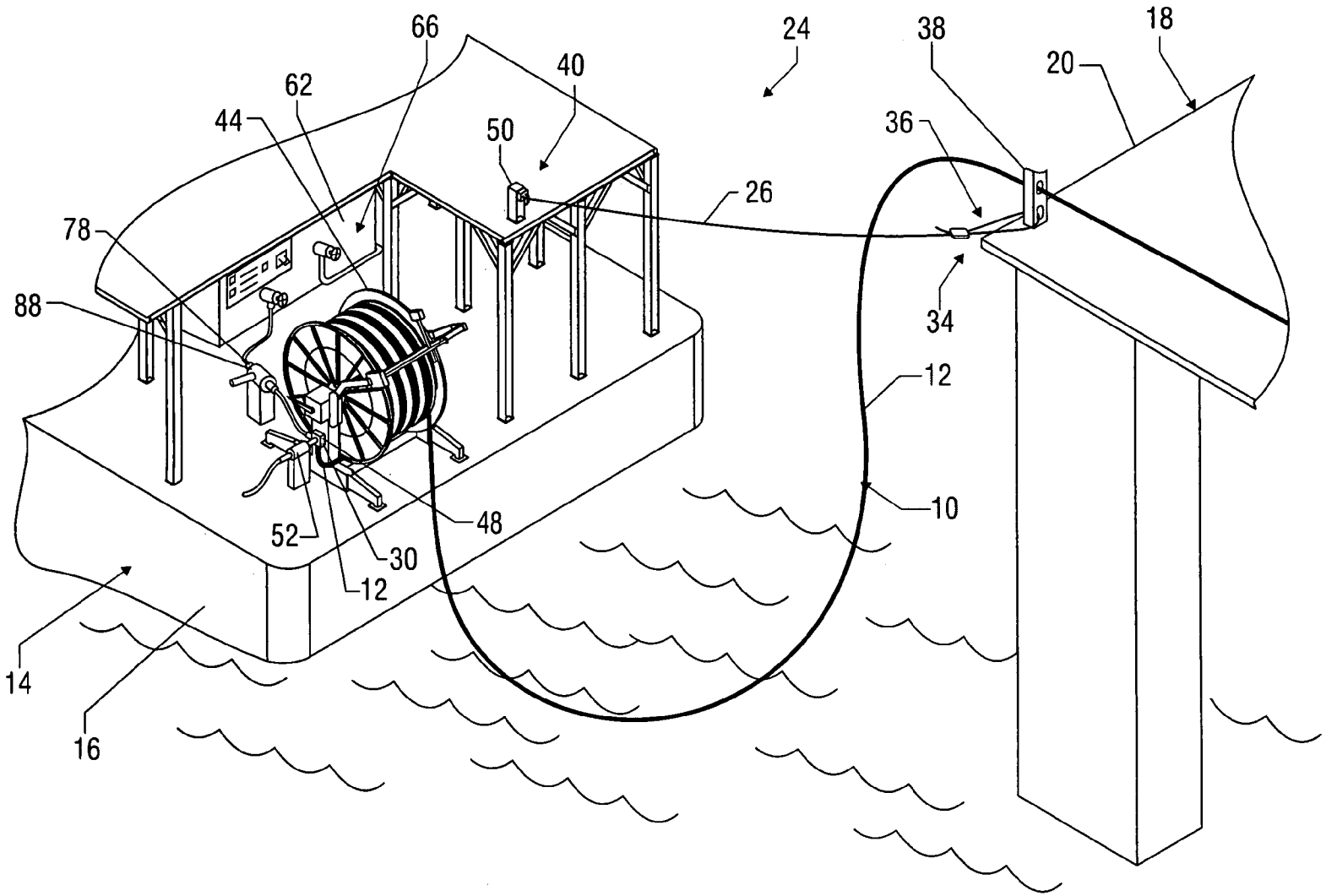
FIG. 1 is a plan view showing an exemplary vessel and structure employing an elongated member release system in accordance with an embodiment of the present disclosure.

Characteristics and advantages of the present disclosure and additional features and benefits will be readily apparent to those skilled in the art upon consideration of the following detailed description of exemplary embodiments of the present disclosure and referring to the accompanying figures. It should be understood that the description herein and appended drawings, being of example embodiments, are not intended to limit the claims of this patent application, any patent granted hereon or any patent or patent application claiming priority hereto. On the contrary, the intention is to cover all modifications, equivalents and alternatives falling within the spirit and scope of the claims. Many changes may be made to the particular embodiments and details disclosed herein without departing from such spirit and scope.

In showing and describing preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout various portions (and headings) of this patent application, the terms "invention", "present invention" and variations thereof are not intended to mean every possible embodiment of the invention or any particular claim or claims. Thus, the subject matter of each such reference should not be considered as necessary for, or part of, every embodiment of the invention or any particular claim(s) merely because of such reference. The terms "coupled", "connected", "engaged" and the like, and variations thereof, as used herein and in the appended claims are intended to mean either an indirect or direct connection or engagement. Thus, if a first device couples to a second device, that connection may be through a direct connection, or through an indirect connection via other devices and connections.

Certain terms are used herein and in the appended claims to refer to particular components. As one skilled in the art will appreciate, different persons may refer to a component by different names. This document does not intend to distinguish between components that differ in name but not function. Also, the terms "including" and "comprising" are used herein and in the appended claims in an open-ended fashion, and thus should be interpreted to mean "including, but not limited to . . . ." Further, reference herein and in the appended claims to components and aspects in a singular tense does not necessarily limit the present disclosure or appended claims to only one such component or aspect, but should be interpreted generally to mean one or more, as may be suitable and desirable in each particular instance.

Referring initially to FIG. 1, an elongated member 10 is shown extending between a waterborne vessel 14 and a structure 18. The illustrated waterborne vessel 14 is a stimulation vessel or "frac boat" 16 and the exemplary structure 18 is a platform 20 used as part of an offshore hydrocarbon recovery system. In this example, the elongated member 10 is a fluid conduit 12 wound on a hose reel 44 on the vessel 14 and used to pump frac fluid, acid, other fluid or fluid-solid mixtures from one or more tanks (not shown) on the vessel 14 to the platform 20. The vessel 14 also includes a decoupler 30 capable of causing the elongated member 10 to be disconnected or released from the vessel 14. For example, the decoupler 30 may include a fluid conduit disconnect 48 capable of disconnecting the elongated member 10 from the reel 44 and/or any other components on the vessel 14.

It should be understood, however, that the present disclosure is not limited to the above arrangement or details. The above-referenced components may be of any desired form and configuration as are or become known or commercially available. For example, the vessel 14 may be any watercraft, barge, tanker or other item that is movable relative to the structure 18. The structure 18 may be a platform, drilling rig or other installation, or any other one or more objects of any form or configuration. In fact, in some embodiments, the structure 18 may be another waterborne vessel. The elongated member 10 may be any type of fluid conduit, such as a high volume and/or high pressure hose, coiled tubing, pipe, power or other type of cable or any other item that is extendable between the vessel 14 and the structure 18. Likewise, the elongated member 10 is not limited to transmitting or communicating any particular material or information. The elongated member 10 need not be carried on a reel 44 and the decoupler 30 need not be a fluid conduit disconnect 48. Furthermore, more than one elongated member 10, vessel 14, structure 18 and components thereof may be included. Accordingly, the type, configuration, location, function and components of the vessel 14, elongated member 10 and structure 18 are not limiting upon the present disclosure.

Still referring to the example of FIG. 1, an elongated member release system 24 in accordance with an embodiment of the present disclosure is shown. The system 24 includes a cable 26 extendable between the vessel 14 and structure 18. The cable 26 of this embodiment is secured or anchored to the structure 18 and releasably connected to the vessel 14. The cable 26 is capable of actuating the decoupler 30 to disconnect the elongated member 10 from the vessel 14. For example, the system 24 may be designed so that the cable 26 causes the decoupler 30 to disconnect the elongated member 10 from the vessel 14 when the distance between the vessel 14 and structure 18 exceeds a desired distance, the cable 26 undergoes sufficient tension, or the occurrence of another particular event or condition. Thereafter, in this embodiment, since the cable 26 is also releasable from the vessel 14, the vessel 14 and/or structure 18 may move apart from one another without the elongated member 10 or cable 26 connected therebetween. Such moving apart of the vessel 14 and structure 18 is sometimes referred to herein as the "separation" thereof.

It should be noted that the present disclosure also contemplates and encompasses modified or reverse arrangements in which the decoupler 30 is instead located on the structure 18, the elongated member 10 extends and is releasable from the structure 18 and the cable 26 is anchored to the vessel 14 and releasably connectable to the structure 18. Accordingly, all of the description herein may be appropriately modified to apply to such reverse arrangements.

The cable 26 may have any suitable form, components and configuration, as long as it is capable of extending between the vessel 14 and structure 18 and, under one or more particular conditions (e.g. the cable 26 undergoes a certain amount of tension or the distance between the vessel and structure exceeds a desired distance), causes the elongated member 10 to be released from the vessel or structure. For example, the cable 26 may be a rip cord. For another example, the cable 26 may include one or more wire ropes and one or more connectors. For yet another example, the cable 26 may include one or more elastic sections. For still a further example, multiple cables 26 may be included. Thus, the form, components and configuration of the cable 26 are not limiting upon the present disclosure.

The cable 26 may be engageable between the vessel 14 and structure 18 in any suitable manner. In the embodiment of FIG. 1, the cable 26 includes first and second portions 34, 40. The illustrated first portion 34 is useful to anchor the cable 26 to the structure 18. For example, the first end 36 of the cable 26 may be securely tied down to a hanger assembly 38 welded to the platform 20. However, any arrangement that provides sufficient support and rigidity to anchor the cable 26 to the structure 18 under the expected tensioning of the cable 26 during deployment and use of the cable 26 and separation of the vessel 14 and structure 18 may be used.

Still referring to the embodiment of FIG. 1, the illustrated second portion 40 associates the cable 26 with the decoupler 30 and releasably connects the cable 26 to the vessel 14. Any suitable arrangement may be used to associate the second portion 40 of the cable 26 with the decoupler 30 and connect it to the vessel 14. If desired, the second portion 40 may be indirectly coupled to or in communication with the decoupler 30. In FIG. 1, for example, the second portion 40 is capable of initiating at least one electric signal to an electrically-actuated hydraulic solenoid valve 52 that actuates the fluid conduit disconnect 48 of the decoupler 30. If included, the electrically-actuated hydraulic solenoid valve 52 may have any suitable construction and configuration, such as may be commercially available. Example current commercially available devices that may be used as an electrically-actuated hydraulic solenoid valve 52 include Parker Hannifin Corporation's BVCS10 series.

Figure 2:
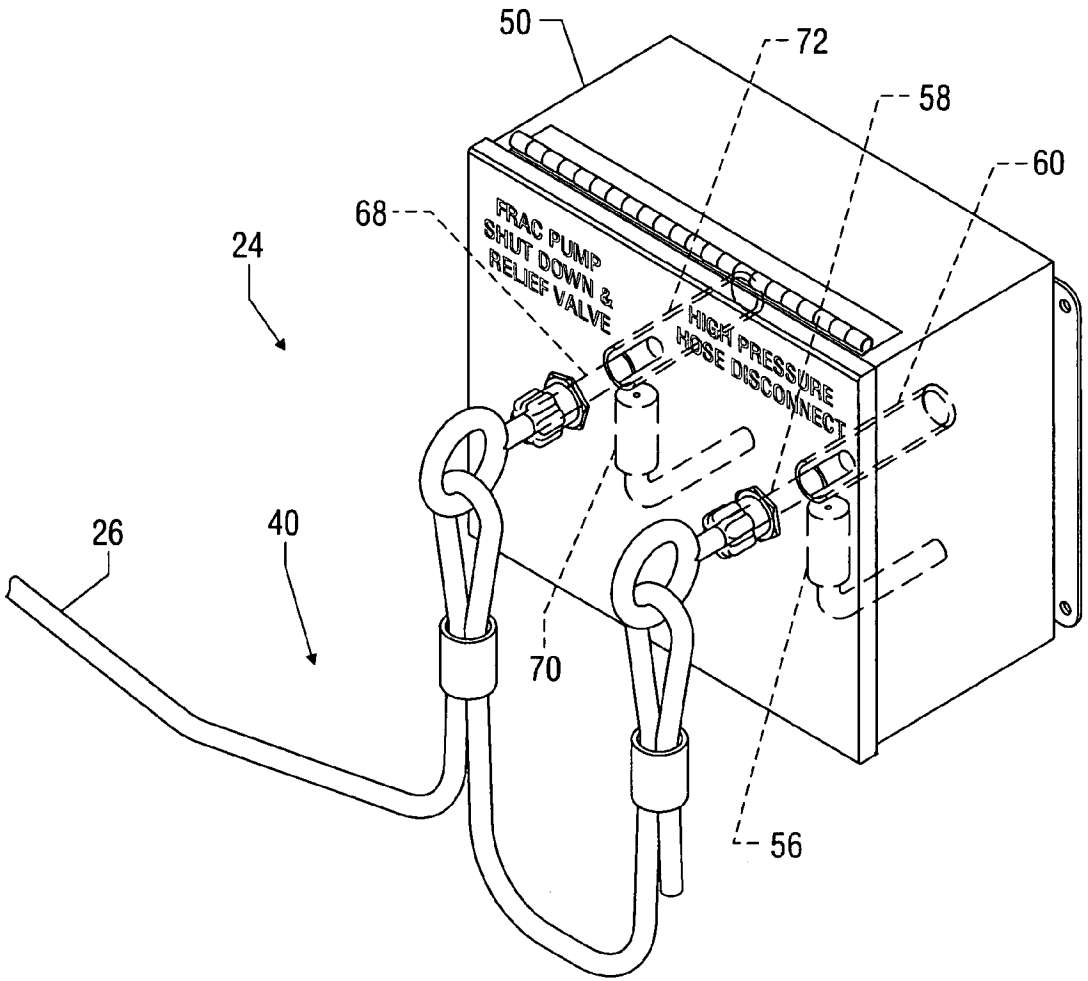
FIG. 2 is an isolated view showing the exemplary cable and junction box illustrated in the embodiment of FIG. 1.
Figure 3:
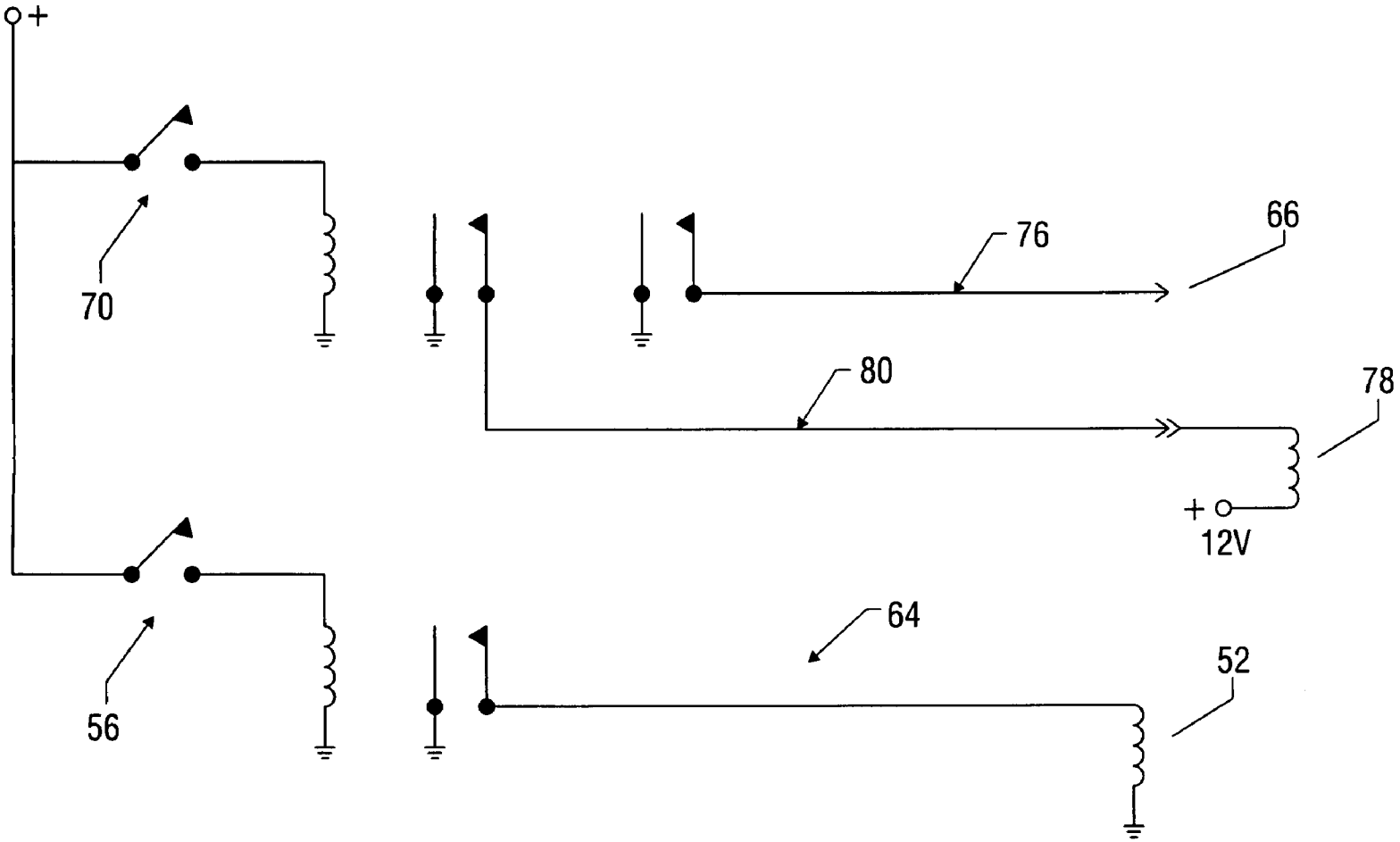
FIG. 3 is a partial schematic diagram depicting exemplary control functions of one embodiment of an elongated member release system in accordance with the present disclosure.

The second portion 40 may communicate with the valve 52 in any suitable manner. In the embodiment of FIG. 1, the second portion 40 is capable of turning on a switch (not shown) in a junction box 50 that provides an electric signal to the valve 52. For example, as shown in FIG. 2, the illustrated second portion 40 includes a first trigger, or pin, 58 slidably engageable in a first pin guide 60 within the junction box 50. The junction box 50 also includes a first proximity switch 56 located proximate to the first pin 58 and electrically coupled to the electro-hydraulic solenoid valve 52 (e.g. FIG. 1). In this embodiment, as the distance between the vessel 14 and structure 18 exceeds a desired distance, such as the length of the cable 26 between its first and second portions 34, 40, or the tension on the cable 26 reaches a certain limit, the first pin 58 is drawn out of the first pin guide 60, actuating or turning on the first proximity switch 56. As shown in FIG. 3, the "on" position of the switch 56 will complete the disconnect circuit 64, providing electric current to the valve 52. The valve 52 then actuates the disconnect 48 (e.g. FIG. 1) to disconnect the elongated member 10 from the vessel 14. As the first pin 58 of this embodiment is drawn entirely out of the first pin guide 60 and junction box 50, the cable 26 releases from the vessel 14.

When included, the junction box 50 may have any suitable form, construction, configuration and location. For example, the junction box 50 may be located proximate to the valve 52 or on the hydraulic power pack of the reel 44. The fluid conduit disconnect 48 may likewise have any suitable construction, configuration and location. Example currently commercially available devices that may be used as a disconnect 48 are sold under the Coflexip® brand by Technip.

In other embodiments, the decoupler 30 may be electronically-actuated, such as by the transmission of a wireless signal initiated by the second portion 40 of the cable 26. For example, sufficient movement apart of the vessel 14 and the structure 18 or tensioning of the cable 26 may actuate an electronic controller (not shown) to provide a wireless transmission to an electronically-actuated hydraulic valve (not shown) or other component, causing the disconnect 48 to release the elongated member 10 from the vessel 14.

If desired, the second portion 40 may instead be capable of directly engaging and actuating the decoupler 30 to release the elongated member 10 from the vessel 14 in any suitable manner. In some embodiments, the disconnect 48 of the decoupler 30 may be actuated by a mechanically-actuated hydraulic valve (not shown) that is releasably engageable with the second portion 40 of the cable 26. For example, the second portion 40 may include a clamp or releasable connector (not shown) that releasably grips a handle (not shown) of the mechanically-actuated hydraulic valve. As the cable 26 is drawn away from the vessel 14, the second portion 40 moves the valve handle to an "open valve" position, causing the disconnect 48 to release the elongated member 10 from the vessel 14, and thereafter releases therefrom, disengaging the cable 26 from the vessel 14.

When included, the mechanically-actuated hydraulic valve may have any suitable construction and configuration, such as may be commercially available. Example current commercially available devices that may be used as a mechanically-actuated hydraulic valve are Parker Hannifin Corporation's 3559108138 model.

Referring again to FIG. 1, in another independent aspect of the present disclosure, the system 24 may also be capable of shutting off the flow of fluid or other material into the elongated member 10. For example, when the elongated member 10 is a fluid conduit 12, the cable 26 may be associated with and capable of communicating with one or more fluid pumps 62 that provide fluid into the conduit 12 from one or more tank (not shown) on the vessel 14. Any suitable fluid pumps may be used. Example current commercially available devices that may be used as a fluid pump 62 include the Wolverine™ high pressure pump sold by BJ Services Company, the assignee of this patent.

The cable 26 may be capable of actuating the pump 62 to stop the flow of fluid into the conduit 12 in any suitable manner. If desired, arrangements similar to those described above with respect to the actuation of the decoupler 30 by the cable 26 may be adapted for this purpose. For example, as shown in the embodiment of FIG. 2, the illustrated second portion 40 of the cable 26 includes a second trigger, or pin, 68 slidably engageable in a second pin guide 72 within the junction box 50. A second proximity switch 70 in the junction box 50 is located proximate to the second pin 68 and electrically coupled to a pump control system 66 (e.g. FIG. 1) that controls the pump(s) 62.

In this example, as the distance between the vessel 14 (e.g. FIG. 1) and structure 18 exceeds a desired distance, such as the length of the cable 26 between its first and second portions 34, 40, the second pin 68 (FIG. 2) is drawn out of the second pin guide 72, turning on the second proximity switch 70. As shown in FIG. 3, the "on" position of the switch 70 will complete the fluid shut-off circuit 76, providing electric current to the pump control system 66 to stop the pump(s) 62 from pumping fluid into the conduit 12. For example, the pump(s) 62 may be shifted into a neutral position. Note, in this embodiment, the release system 24 is arranged so that the second pin 68 acts first to stop fluid flow into the elongated member 10 and, thereafter, the first pin 58 actuates the decoupler 30 to disconnect the elongated member 10 from the vessel 14.

Referring again to FIG. 1, in yet another independent aspect of the present disclosure, the system 24 may be capable of opening one or more relief valves 78 associated with the elongated member 10. Any suitable relief valves may be used. Example current commercially available devices that may be used as a relief valve 78 are sold by FMC Technologies. If desired, arrangements similar to those described above with respect to the actuation of the decoupler 30 or fluid pump(s) 62 by the cable 26 may be adapted for this purpose. For example, referring to FIG. 2, the second proximity switch 70 actuated by the second pin 68 may also be electrically coupled to one or more electrically-actuated solenoid relief valves 82 (e.g. FIG. 1). As shown in FIG. 3, the "on" position of the switch 70 will also complete the relief valve circuit 80, providing electric current to the relief valve(s) 82, which will release fluid pressure in the elongated member 10.

In the embodiment of FIGS. 1 and 2, the release system 24 is thus arranged so that the second pin 68 acts first to stop fluid flow into the elongated member 10 and open one or more relief valve 78 and, thereafter, the first pin 58 actuates the decoupler 30 to disconnect the elongated member 10 from the vessel 14. Both pins 68, 58 may disengage completely from the junction box 50, releasing the cable 26 from the vessel 14. It should be understood, however, that the present disclosure is not limited to this particular arrangement or any of the above details. The elongated member release system 24 may be configured to shut off the flow of fluid or other material into the elongated member 10, open one or more relief valve 78 and separate from the vessel 14 in any suitable manner. Moreover, the fluid shut-off and relief valve actuation capabilities may not be included.

Preferred embodiments of the present disclosure thus offer advantages over the prior art and are well adapted to carry out one or more of the objects of the invention. However, the present invention does not require each of the components and acts described above and is in no way limited to the above-described embodiments, methods of operation, variables, values or value ranges. Any one or more of the above components, features and processes may be employed in any suitable configuration without inclusion of other such components, features and processes. Moreover, the present invention includes additional features, capabilities, functions, methods, uses and applications that have not been specifically addressed herein but are, or will become, apparent from the description herein, the appended drawings and claims.

The methods that may be described above or claimed herein and any other methods which may fall within the scope of the appended claims can be performed in any desired suitable order and are not necessarily limited to any sequence described herein or as may be listed in the appended claims. Further, the methods of the present invention do not necessarily require use of the particular embodiments shown and described herein, but are equally applicable with any other suitable structure, form and configuration of components.

While exemplary embodiments of the invention have been shown and described, many variations, modifications and/or changes of the system, apparatus and methods of the present invention, such as in the components, details of construction and operation, arrangement of parts and/or methods of use, are possible, contemplated by the patent applicant(s), within the scope of the appended claims, and may be made and used by one of ordinary skill in the art without departing from the spirit or teachings of the invention and scope of appended claims. Thus, all matter herein set forth or shown in the accompanying drawings should be interpreted as illustrative, and the scope of the disclosure and the appended claims should not be limited to the embodiments described and shown herein.

The invention claimed is:

1. Apparatus comprising:

at least one elongated member extendable between a waterborne vessel and a structure located proximate to the waterborne vessel, said at least one elongated member being releasably engageable with the waterborne vessel;

a decoupler disposed upon the waterborne vessel and associated with said at least one elongated member, said decoupler being configured to release said at least one elongated member from the waterborne vessel when the distance between the waterborne vessel and the structure exceeds a desired distance; and a cable extendable between the waterborne vessel and the structure, said cable including at least a first portion useful to anchor said cable to the structure and at least a second portion useful to releasably attach said cable to the waterborne vessel, said second portion being associated with and capable of actuating said decoupler, wherein said second portion of said cable is capable of both causing said decoupler to release said at least one elongated member from the waterborne vessel and disconnecting said cable from the waterborne vessel when the distance between the waterborne vessel and the structure exceeds a desired distance.

2. The apparatus of claim 1 wherein the structure includes at least one among a platform and a rig and the desired distance between the waterborne vessel and the structure is the length of said cable between said first and second portions thereof.

3. The apparatus of claim 2 wherein said second portion of said cable is directly engageable with said decoupler and, upon sufficient tensioning of said cable, directly actuates said decoupler to release said at least one elongated member from the waterborne vessel.

4. The apparatus of claim 2 wherein said second portion of said cable indirectly communicates with said decoupler and, upon sufficient tensioning of said cable, triggers the transmission of at least one signal to said decoupler to cause said decoupler to release said at least one elongated member from the waterborne vessel.

5. The apparatus of claim 2 wherein said at least one elongated member includes at least one among a high volume fluid conduit, a high pressure fluid conduit and a power cable.

6. The apparatus of claim 1 wherein said at least one elongated member includes a fluid conduit and said decoupler includes a fluid conduit disconnect capable of releasing said at least one elongated member from the waterborne vessel.

7. The apparatus of claim 6 wherein said fluid conduit disconnect is actuated by a mechanically-actuated hydraulic valve and said second portion of said cable is capable of actuating said mechanically-actuated hydraulic valve to cause said fluid conduit disconnect to release said fluid conduit from the waterborne vessel.

8. The apparatus of claim 7 further including a first releasable connector engageable between said second portion of said cable and said mechanically-actuated hydraulic valve, said releasable connector being capable of assisting in actuating said mechanically-actuated hydraulic valve and disconnecting said second portion of said cable from said mechanically-actuated hydraulic valve.

9. The apparatus of claim 6 wherein said fluid conduit disconnect is actuated by an electrically-actuated hydraulic valve and said second portion of said cable is capable of initiating communication of at least one electrical signal to said electrically-actuated hydraulic valve to cause said fluid conduit disconnect to release said fluid conduit from the waterborne vessel.

10. The apparatus of claim 9 wherein said second portion of said cable includes a first pin associated with and positionable proximate to a first proximity switch, said first proximity switch being electrically coupled to said electrically-actuated hydraulic valve, wherein upon sufficient tensioning of said cable, said first pin moves away from said first proximity switch, causing said first proximity switch to transmit at least one electrical signal to said electrically-actuated hydraulic valve.

11. The apparatus of claim 6 wherein said fluid conduit disconnect is actuated by an electronically-actuated hydraulic valve and said second portion of said cable is capable of initiating communication of at least one electronic signal to said electronically-actuated hydraulic valve to cause said fluid conduit disconnect to release said fluid conduit from the waterborne vessel.

12. The apparatus of claim 11 wherein said second portion of said cable initiates the transmission of at least one wireless communication signal to said electronically-actuated hydraulic valve to cause said fluid conduit disconnect to release said fluid conduit from the waterborne vessel.

13. The apparatus of claim 6 further including a pumping system disposed upon the waterborne vessel and capable of providing fluid into said fluid conduit, wherein said second portion of said cable is capable of causing said pumping system to stop providing fluid into said fluid conduit.

14. The apparatus of claim 13 wherein said pumping system is electrically-actuated, wherein said second portion of said cable includes a second pin associated with and positionable proximate to a second proximity switch, said second proximity switch being electrically coupled to said electrically-actuated pumping system, wherein upon sufficient tensioning of said cable, said second pin moves away from said second proximity switch, causing said second proximity switch to transmit at least one electrical signal to said electrically-actuated pumping system to cause it to stop providing fluid into said fluid conduit.

15. The apparatus of claim 14 further including an electrically-actuated relief valve disposed upon the waterborne vessel and associated with at least one among said pumping system and said fluid conduit, wherein said second proximity switch is electrically coupled to said electrically-actuated relief valve, whereby when said second pin moves away from said second proximity switch, said second proximity switch provides an electrical signal to said electrically-actuated relief valve to cause it to open.

16. Apparatus comprising:

at least one elongated member extendable between a waterborne vessel and another object, said at least one elongated member originating from and being releasably engageable with the other object;

a decoupler disposed upon the other object and capable of releasing said at least one elongated member from the other object when the distance between the waterborne vessel and the other object exceeds a desired distance; and a cable extendable between the other object and the waterborne vessel, said cable including at least a first portion useful to anchor said cable to the waterborne vessel and at least a second portion useful to releasably attach said cable to the other object, said second portion being associated with and capable of actuating said decoupler, wherein said second portion of said cable is capable of both causing the said decoupler to release said at least one elongated member from the other object and disconnecting said cable from the other object when the distance between the waterborne vessel and the structure exceeds a desired distance.

17. The apparatus of claim 16 wherein the other object includes at least one among a platform and a rig and the desired distance between the waterborne vessel and the other object is the length of said cable between said first and second portions thereof.

18. Apparatus comprising:

at least one elongated member configured to extend between a waterborne vessel and another object, said at least one elongated member originating from and being releasably engageable with the waterborne vessel;

a decoupler disposed upon the waterborne vessel and capable of releasing said at least one elongated member therefrom; and a rip cord extendable between the waterborne vessel and the other object, said rip cord including at least a first portion useful to anchor said rip cord to the other object and at least a second portion useful to releasably attach said rip cord to the waterborne vessel, said second portion being associated with said decoupler and capable of causing said decoupler to release said at least one elongated member from the waterborne vessel, whereby when the distance between the waterborne vessel and the other object exceeds the length of said rip cord between said first and second portions thereof, said second portion of said rip cord causes said decoupler to release said at least one elongated member from the waterborne vessel.

19. System for disconnecting at least one fluid conduit extending from a waterborne vessel to a structure when the distance therebetween exceeds a desired distance, the waterborne vessel including at least one pump capable of pumping fluid into the at least one fluid conduit and a fluid conduit disconnect capable of releasing the at least one fluid conduit from the waterborne vessel, the system comprising:

a first switch capable of causing the pump to stop pumping fluid into the at least one fluid conduit;

a second switch capable of causing the fluid conduit disconnect to release the at least one fluid conduit from the waterborne vessel; and a rip cord releasably engageable between the waterborne vessel and the structure, said rip cord being associated with and capable of actuating said first and second switches to cause the pump to stop pumping fluid into the at least one fluid conduit and the at least one fluid conduit to be separated from the waterborne vessel, respectively, when the distance between the waterborne vessel and the structure exceeds a desired distance.

20. The system of claim 19 wherein said rip cord is directly releasably engageable with said first and second switches, wherein when the distance between the waterborne vessel and the structure exceeds a desired distance, said rip cord actuates said first and second switches and disengages therefrom, causing the pump to stop pumping fluid into the at least one fluid conduit, releasing the at least one fluid conduit from the waterborne vessel and disconnecting said rip cord from the waterborne vessel.

21. The system of claim 19 wherein the pump and fluid conduit disconnect are electrically actuated and said first and second switches are first and second proximity switches, further wherein said rip cord includes first and second releasable connectors positionable proximate to said first and second proximity switches, respectively, wherein when the distance between the waterborne vessel and the structure exceeds a desired distance, said first and second releasable connectors move away from said first and second proximity switches, respectively, causing said first and second proximity switches to provide respective electrical signals to the pump to cause it to stop providing fluid into the at least one fluid conduit and the fluid conduit disconnect to cause it to release the at least one fluid conduit from the waterborne vessel and disconnecting said rip cord from the waterborne vessel.

22. Method of automatically disconnecting a waterborne vessel from a structure releasably connectable by at least one elongated member extending from the waterborne vessel, the method comprising:

providing a decoupler on the waterborne vessel, the decoupler capable of releasing the at least one elongated from the waterborne vessel;

anchoring a first portion of a cable to the structure;

associating a second portion of the cable with the decoupler, the second portion being capable of causing the decoupler to release the at least one elongated member from the waterborne vessel;

releasably connecting the second portion of the cable to the waterborne vessel; and when the distance between the waterborne vessel and the structure exceeds a particular distance, the second portion of the cable causes the decoupler to release the at least one elongated member from the waterborne vessel and causing the cable to disconnect from the waterborne vessel.

* * * * *